United States Patent [19]

Schoeneweis

[11] Patent Number: 4,887,766

[45] Date of Patent: Dec. 19, 1989

[54] CONTAINER AND ONE-PIECE BLANK FOR FORMING SAME

[76] Inventor: Melvin W. Schoeneweis, P.O. Box 369, California, Mo. 65018

[21] Appl. No.: 230,493

[22] Filed: Aug. 10, 1988

[51] Int. Cl.[4] ..... B65D 5/64

[52] U.S. Cl. ..... 229/125; 229/143

[58] Field of Search ..... 229/183, 182, 181, 187, 229/125, 155, 143, 142, DIG. 4, 126; 206/612, 608

[56] References Cited

U.S. PATENT DOCUMENTS

| | | | |
|---|---|---|---|
| 2,122,654 | 7/1938 | Nickerson | 229/181 |
| 2,732,995 | 1/1956 | Geisler et al. | 229/183 |
| 3,207,414 | 9/1965 | Locke et al. | 229/125 |
| 3,468,469 | 9/1969 | Kossoff et al. | 229/143 |
| 3,727,827 | 4/1973 | Stice | 229/125 |
| 4,059,221 | 11/1977 | Olson et al. | 229/185 |
| 4,572,424 | 2/1986 | Muise et al. | 229/185 |
| 4,702,409 | 10/1987 | Osborne | 229/125 |
| 4,740,163 | 4/1988 | Kuchenbecker | 206/612 |

FOREIGN PATENT DOCUMENTS

| | | | |
|---|---|---|---|
| 35836 | 3/1926 | Denmark | 229/155 |
| 2329522 | 7/1977 | France | 229/143 |
| 562939 | 5/1957 | Italy | 229/126 |

*Primary Examiner*—Stephen P. Garbe
*Assistant Examiner*—Jes F. Pascua
*Attorney, Agent, or Firm*—Kalish & Gilster

[57] ABSTRACT

A rectilinear rigid and closable poultry or red meat container assembled by travel of a male forming mandrel pushing a single blank of paperboard past a series of wings and rollers. The container blank is complete with container base, end walls, side walls, bridge tabs and closable lid. The closable lid sections are interconnected with the end walls by a bridge tab between the lid section flanges and the end wall flanges. This bridge tab permits the use of simple machinery heretofore only suitable for assembly of open top containers which therefore are not lid-integral. Additionally, integral with the single blank are side wall flanges and end wall flanges which provide near complete triple thickness side walls upon assembly, imparting increased stacking strength sufficient to permit use of economically advantageous relatively light weight paperboard.

4 Claims, 2 Drawing Sheets

FIG. 1
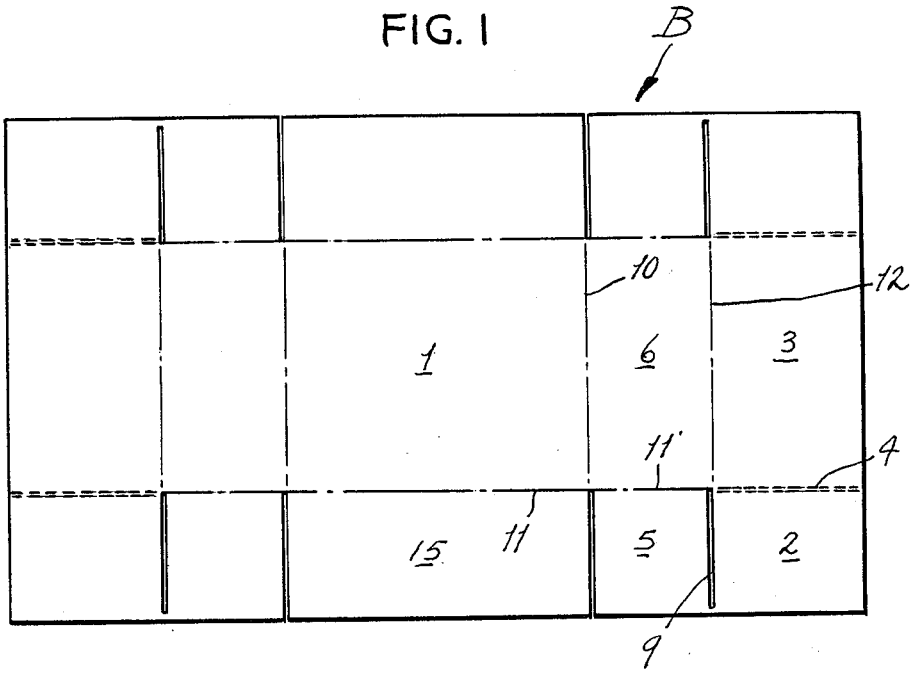
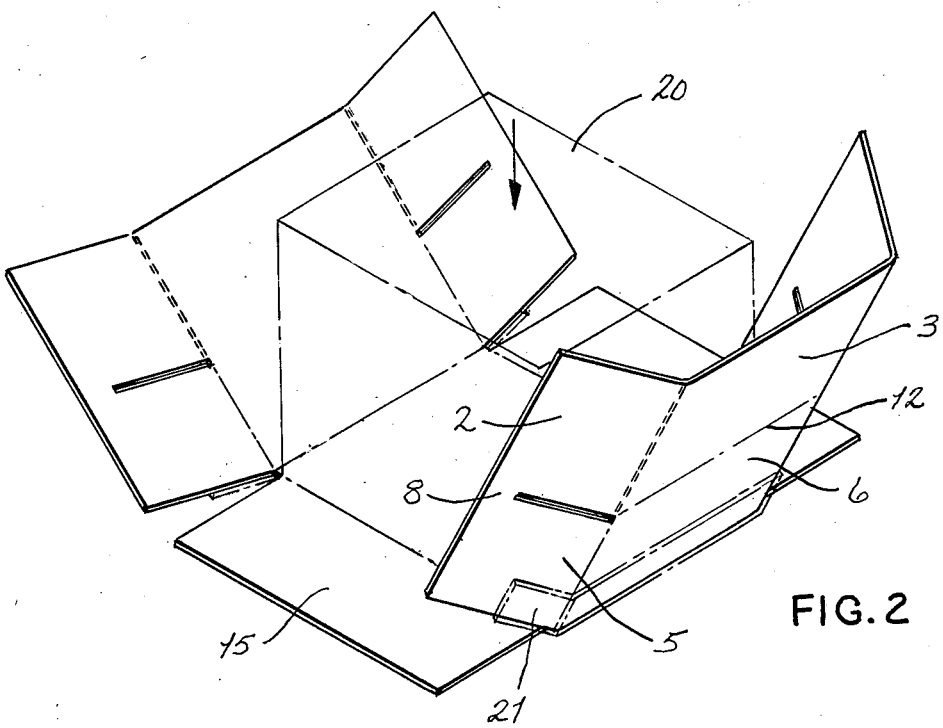
FIG. 2

CONTAINER AND ONE-PIECE BLANK FOR FORMING SAME

BACKGROUND OF THE INVENTION

The present invention relates to containers and, more specifically, to paperboard containers for storage and shipment, being especially adapted for poultry and red meat products.

The prior art in this field lacks an effective means of incorporating a closable lid integral with the container while maintaining a simple blank design which could be assembled by simple container forming and container closing/sealing machines.

Attempts to use simple rectangular lid-integral blanks have failed because flanges hingedly attached to the lid sections need to be free-flapping in order to facilitate closure of the container. The free-flapping flanges create problems by inappropriately interfering with and being damaged by the wings, roller and stationary shapes past which the male forming mandrel and blank travel during assembly. In light of this defect, containers of this sort heretofore have only been formable by use of either complex one-piece container blanks or two-piece constructions. The lid-integral one-piece containers of the prior art generally have been formed from complicated blank designs. Characteristic of these blank designs has been wasteful generation of substantial amounts of paperboard scrap due to incorporation of irregularly shaped extensions, flaps, protuberances, gussets, tabs, slots, angles and the like. Exemplary of such are revealed in Olson Pat. No. 4,059,221; and Muise Pat. No. 4,572,424. Formation of the container from the blank generally has required costly complex pressing equipment requiring the employment of multiple operative steps.

The various geometric features of the complicated one-piece blanks have tended to be awkward and free-flapping. These features often have interfered with rollers or other machinery during assembly and thus could be easily damaged. Inherent design deficiencies have necessitated the use of high density paperboard to achieve the requisite strength.

Also typical of such prior constructions has been the tendency that the container spring open. This necessitates use of uneconomical quantities of adhesive to secure integrity of the container.

Two-piece containers of this general, prior art character often have required manual assembly. There has also been the difficulty inherent in achieving a consistently snug fit of the lid onto the box. Two-piece constructions have been generally awkward to handle during assembly and the subsequent filling operations; and have had relatively weak stacking strength in light of the amount of paperboard required per unit.

Each piece of such two-piece containers generally has been assembled by passage of a male forming mandrel pushing a paperboard blank past a series of wings, rollers and stationary shapes. Though this is an appropriately simple method of assembly, it has heretofore not been suitable for formation of containers from a one-piece, lid-integral paperboard blank, due to interference of the lid features with the wings and rollers.

SUMMARY OF THE INVENTION

It is, therefore, an object of this invention to provide a container formed from a simple, one-piece paperboard blank.

It is another object of the present invention to provide a paperboard container of the type stated wherein the initial blank includes a defined closable lid.

It is a further object of the present invention to provide a paperboard container of the type stated wherein the cutting of the original blank economically generates a minimal amount of paperboard scrap.

It is a still further object of the present invention to provide a paperboard container assembled by means of simple, relatively inexpensive equipment.

It is another object of the present invention to provide a paperboard container of the type stated wherein the original blank is devoid of free-flapping extensions which can be damaged or interfere with wings, rollers or other forming machinery.

It is another object of the present invention to provide a paperboard container of an extremely efficient design which, by allowing use of a low density paperboard, provides substantial material savings while also providing greater stacking strength.

It is still another object of the present invention to provide a paperboard container of the type stated which does not have a tendency to open up into a flat layout position.

It is an object of the present invention to provide a paperboard container of the type stated which can be used especially for packaging of meat, e.g., poultry and red meat products.

Briefly, the present invention comprises a rectilinear rigid container assembled by travel of a male forming mandrel pushing a single rectangular paperboard blank past a female container-forming apparatus. The blank comprises a container base panel having an area equal to that of the completed container's top opening a pair of parallel, opposed end wall panels; a pair of parallel, opposed side wall panels positioned pependicular to and intervening the end wall panels upon assembly; the side and end wall panels together defining a rectangular perimeter of said container's top opening, and together having an area equal to that of said container base panel; a pair of lid sections integral with and hingedly attached to the end wall panels along fold lines, the lid sections being of sufficient width that when bent inward along such fold lines as to substantially and completely cover such assembled container top opening (as illustrated); four end wall flange panels, two of which are oppositely and hingedly attached to each of said end wall panels, said end wall flange panels providing double thickness support to the side wall panels and thereby increasing the stacking strength of the assembled container; four lid section flange panels, two of which are oppositely and hingedly attached to each of said lid sections; said lid section flange panels providing triple thickness support to the side wall panels and thereby increasing the stacking strength of the assembled container; four bridge tabs, one of which ridgidly maintains each lid section flange panel integral with its adjacent end section flange panel, thereby preventing said lid section flanges from free movement or inappropriately contacting the container-forming apparatus during assembly; each bridge tab being removable during assembly to facilitate closure to the container.

Other objects and features of the present invention will appear from the description, drawings and claims.

BRIEF DESCRIPTION OF THE DRAWINGS

FIG. 1 is a top plan view of a box blank constructed in accordance with and embodying the present invention, illustrating same in a flat layout position.

FIG. 2 is a perspective view of the box of the present invention during the initial assembly stage.

DESCRIPTION OF THE PREFERRED EMBODIMENT

Figure 4:
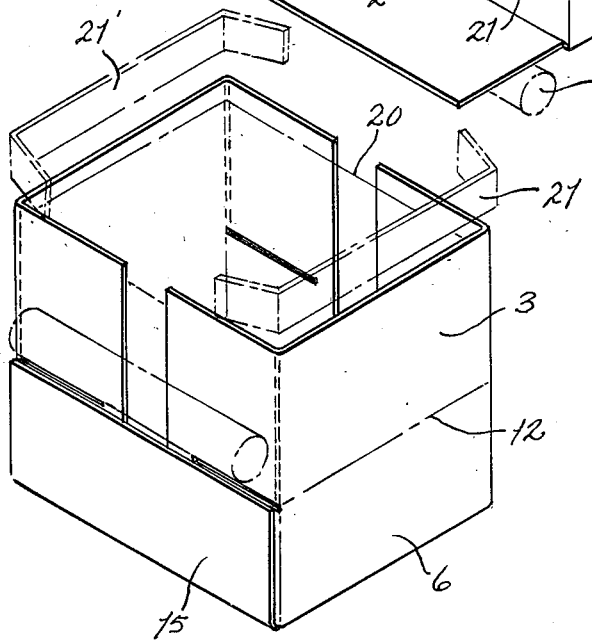
FIG. 4 is a perspective view of the box in a subsequent orientation position during continued further assembly operation.
Figure 5:
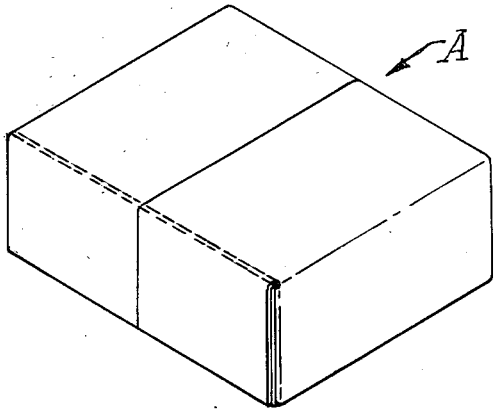
FIG. 5 is a pespective view of the box after a final assembly operation, with box-top side flaps folded on the exterior of the side panels.

Referring now by reference characters to the drawings, B generally indicates a container blank for formation of a container A of ultimate configuration as shown in FIG. 5. The assembly of container A is accomplished by means of travel of a male forming mandrel 20 pushing container blank B past a female container-forming apparatus including a series of opposed folding wings 21, 21' and opposed rollers 22, 22'(FIG. 4).

Discussion of the invention is hereinbelow appropriately limited to one quadrant of the blank B due to the symmetrical nature of the embodiment.

Blank B is suitably die cut to provide a container base 1 which is bendably attached to an end wall panel 6 and a side wall panel 15 along fold lines (i.e., lines of weakness) 10 and 11 respectively. Said blank B also constitutes a lid flange 2 which is hingedly integral with lid section 3 along fold line 4. Fold line 4 may be in the nature of for example, a crease, impression, score, double score, skip-cut or peforation. It is shown here as a double perforated score, the inner score being colinear with a portion 11' of the line of weakness 11, said portion 11' hinging the end wall flange panel 5 to end wall panel 6. Such alignment facilitates the folding of lid flange 2 sequentially with the folding of end wall flange panel 5. The outer score facilitates the folding over the side walls of said lid flange upon assembly as shown in FIG. 5.

Lid flange panel 2 is rigidly attached to end wall flange panel 5 by means of a bridge tab 8, located at the exterior-most end of a line of weakness 9, said bridge tab and line of weakness together forming the joint between lid flange panel 2 and end wall flange panel 5. Line 9, shown here as a slot, may also be in the nature of a score, peforation, skip-cut, impression or cut through.

Bridge tab 8 extends less than half and preferably less than approximately 10% of the length of the joint between lid flange panel 2 and end wall flange panel 5.

Figure 3:
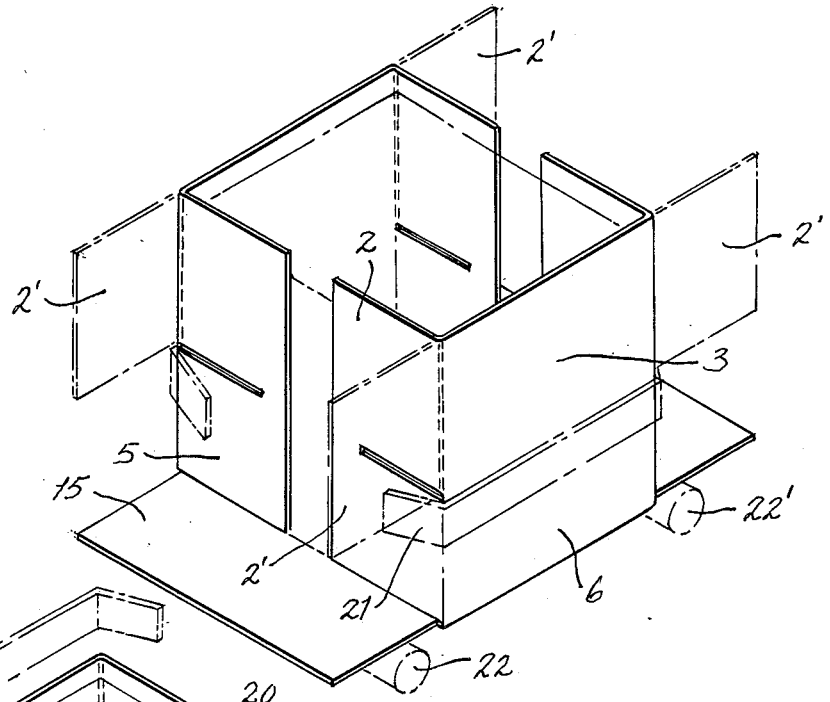
FIG. 3 is a perspective view of the box in a succeeding orientation position during assembly.

Bridge tab 8 ensures that lid flange 2 is interconnectingly carried by end wall flange 5 in mutually planar relationship as end wall flange 5 is folded in by means of travel past wing 21 during assembly (FIG. 2). If lid flange panel 2 were not so rigidly attached to end wall flange panel 5 by bridge tab 8, lid flange panel 2 would freely extend outward from and parallel to lid section 3. If so extended, as shown in FIG. 3 in phantom as 2', lid flange panel 2 would inappropriately come into contact with, and be damaged by, wing 21 as the blank passes said wing during travel of male forming mandrel 20 pushing said blank. Bridge tab 8 also suitably keeps lid flange panel 2 from inappropriately contacting and being damaged by roller 22. Bridge tab 8 therefore permits use of a lid intregral blank with the assembly method as herein described which otherwise and heretofore was only suitable for open containers devoid of any closable lid.

Once the container has been assembled to the configuration shown in FIG. 4, bridge tab 8 may be removed either mechanically or manually. Bridge tab 8 is thus sliced or punch-removed to facilitate closing of the lid, Section 3, as shown in FIG. 5, to completely cover the top opening area of the completed container, and wherein lid flange panel 2, as now freed from end wall flange panels 5, is free to overlap end wall flange panel 5.

FIGS. 4 and 5 demonstrate that approximately 94% of the length of the side walls of the fully assembled container are triple thickness. This triple thickness construction is substantially stronger than designs currently in use and thereby pemits the use of lighter weight paperboard.

The container is secured, as by adhesive along the interior face of side wall 15. Additional strength is provided by using adhesive between lid flange 2 and sidewall 15.

In view of the foregoing, it will be seen that the several objects of the invention are achieved and other advantages are attained.

Although the foregoing includes a description of the best mode contemplated for carrying out the invention, various modifications are contemplated.

As various modifications could be made in the constructions herein described and illustrated without departing from the scope of the invention, it is intended that all matter contained in the foregoing description or shown in the accompanying drawings shall be interpreted as illustrative rather than limiting.

What is claimed is:

1. A rectilinear rigid container assembled by travel of a male forming mandrel pushing a single rectangular blank of paperboard past a female container-forming apparatus, said single blank of paperboard comprising:

a container base panel;

a pair of parallel, opposed end wall panels;

a pair of parallel, opposed side wall panels positioned pependicular to and intervening the end wall panels upon assembly;

said side and end wall panels together defining a rectangular perimeter of said container's top opening, having a circumference equal to that of said container base panel;

a pair of lid sections integral with and hingedly attached to the end wall panels along fold lines;

said lid sections being of sufficient width and length that when bent inward along such fold lines as to substantially and completely cover such assembled container top opening area;

four end wall flange panels, two of which are oppositely and hingedly attached to each of said end wall panels, said end wall flange panels providing double thickness support to the side wall panels and thereby increasing the stacking strength of the assembled container;

four lid section flange panels, two of which are oppositely and hingedly attached to each of said lid sections, each lid section flange panel being bendably attached to its adjacent lid section by means of a double line of weakness so as to provide for closure of the container;

said lid section flange panels providing triple thickness support to the side wall panels and thereby increasing the stacking strength of the assembled container;

four bridge tabs, one of which rigidly maintains each lid section flange panel integral and mutually planar with its adjacent end section flange panel, thereby preventing said lid section flanges from free movement or inappropriately contacting the female container-forming apparatus during assembly; each bridge tab being removable during assembly to facilitate closure of the container.

2. A container as recited in claim 1 wherein each line of a double line of weakness is a peforation.

3. A rectilinear rigid container assembled by travel of a male forming mandrel pushing a single rectangular blank of paperboard past a female container-forming apparatus, said single blank of paperboard comprising:

a container base panel, having a circumference equal to that of said container's top opening upon assembly;

a pair of parallel, opposed end wall panels;

a pair of lid sections integral with and hingedly attached to the end wall panels along fold lines, said lid sections being of sufficient width and length that when bent inward along such fold lines as to substantially cover such assembled container top opening;

four end wall flange panels, two of which are oppositely and hingedly attached to each of said end wall panels;

four lid section flange panels, two of which are oppositely and hingedly attached to each of said lid sections, each lid section flange panel being bendably attached to its adjacent lid section by means of a double line of weakness so as to provide for closure to the container; said lid section flange panels combining with said end wall flange panels to provide substantially continuous double thickness container side walls upon assembly;

four bridge tabs, one of which rigidly maintains each lid section flange panel integral and mutually planar with its adjacent end section flange panel, thereby preventing said lid section flanges from free movement or inappropriately contacting the female container-forming apparatus during assembly; each bridge tab being removable during assembly to facilitate closure of the container.

4. A container as recited in claim 3 wherein each line of weakness is a perforation.

* * * * *

UNITED STATES PATENT AND TRADEMARK OFFICE

CERTIFICATE OF CORRECTION

PATENT NO. : 4,887,766

DATED : Dec. 19, 1989

INVENTOR(S) : Melvin W. Schoeneweis

It is certified that error appears in the above-identified patent and that said Letters Patent is hereby corrected as shown below:

Col. 5, li. 17, delete "peforation" and insert --perforation--;

Col. 6, li. 13, delete "to" and insert --of--.

Signed and Sealed this

Sixteenth Day of October, 1990

*Attest:*

HARRY F. MANBECK, JR.

*Attesting Officer*

*Commissioner of Patents and Trademarks*